United States Patent [19]

Mayes

[11] 4,106,475

[45] Aug. 15, 1978

[54] DRAFT AIR CONTROL SYSTEM

[76] Inventor: Clell C. Mayes, P.O. Box 8, Pigeon Forge, Tenn. 37863

[21] Appl. No.: 792,536

[22] Filed: May 2, 1977

[51] Int. Cl.[2] ..... F24B 7/02

[52] U.S. Cl. ..... 126/121; 126/143; 126/242

[58] Field of Search ..... 126/120, 121, 242, 143

[56] References Cited

U.S. PATENT DOCUMENTS

| | | | |
|---|---|---|---|
| 948,007 | 2/1910 | Doane | 126/121 |
| 1,587,227 | 6/1926 | Hallberg | 126/121 |
| 2,740,398 | 4/1956 | Collins | 126/242 X |
| 2,819,711 | 1/1958 | Robinson | 126/242 X |
| 2,863,443 | 12/1958 | Hoffman | 126/121 |
| 3,845,754 | 11/1974 | Wilkening | 126/121 |
| 3,926,174 | 12/1975 | Bell | 126/143 X |
| 3,976,048 | 8/1976 | Ashman | 126/143 |

*Primary Examiner*—Allen M. Ostrager
*Attorney, Agent, or Firm*—Fitch, Even, Tabin & Luedeka

[57] ABSTRACT

A draft air control system for fireplaces comprising a duct having an outside end in fluid communication with outside air and inside end terminating at a location below the fireplace grate, damper means adjustably controlling the cross-sectional area of the duct, hood means covering the inside terminal end. The hood means comprises a throat section passageway in fluid communication with the duct, a second passageway directing airflow in a generally lateral direction and including a downwardly opening outlet to permit essentially unrestricted airflow from the duct into the fireplace beneath the grate and essentially preventing passage of particulate matter into the duct.

5 Claims, 2 Drawing Figures

DRAFT AIR CONTROL SYSTEM

Figure 1:
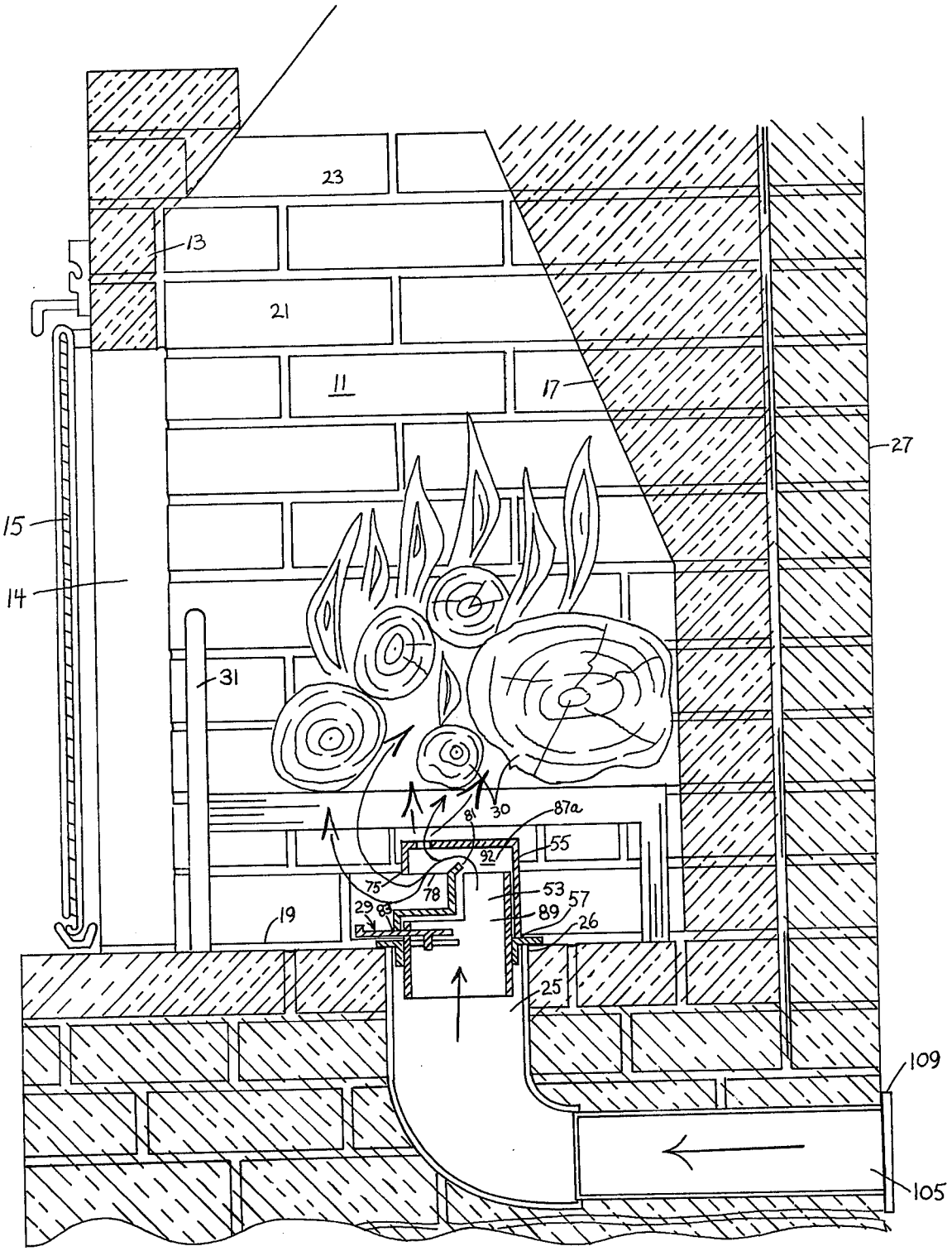

The present invention relates generally to the field of fireplaces, stoves and other fire-containing enclosures and more specifically to a system for providing draft and/or combustion air to such enclosures.

Fires in fireplaces, or other interior enclosures such as stoves generally create an impression of warmth to a person present in the room which the fireplace adjoins. However, quite frequently the overall effect of a fire is to cool a dwelling rather than to heat it. The reason for this effect is that a fire induces a continuous flow of air, called draft air, from the room which the fireplace adjoins, into the fireplace. Once within the fireplace, a portion of the oxygen in the draft air is consumed in the combustion. The gases released by combustion (predominately carbon dioxide) mix with the other air gases in the draft air, all of which gases are heated by the exothermic reaction of combustion. The heated gases then rise up the chimney for exit to the atmosphere. Most of the heat produced by the fire is thus transferred to the draft air which is promptly released to the outside atmosphere, rather than to the air contained within the building. To compound the problem, other means, such as a furnace, are typically used to heat the room air, and this additional energy is also dissipated up the chimney. In addition, because air is being withdrawn from the dwelling, creating a relatively low pressure therein, air is simultaneously drawn into the dwelling to replace it. This replacement air naturally comes from outside the dwelling and is generally colder than the occupant desires.

Although there is a certain amount of energy transferred from the fire to the room by means of radiant energy, the amount is rarely sufficient to overcome the loss caused by the transfer of air. Thus, the net effect of a burning fire is to replace the arm room air, which is frequently heated by a furnace, with cold outside air.

It has been found that a direct supply of outside air to the fireplace diminishes energy losses because furnace-heated air is not removed, nor is there a constant influx of cold outside air into the interior of the building. To this end, outside air is conveyed by conduit means directly into the fireplace, without first passing through the dwelling space. However, efforts along these lines have suffered from a variety of inadequacies. For example, in Hallberg U.S. Pat. No. 1,587,227 a fireplace is disclosed in which a duct is provided in the fireplace floor and outside air is directed by conduit means from outside the building to the duct. Ashes drop freely through the duct to an ash pit disposed below the level of the fireplace floor. However, it has been found that such an unprotected duct develops an accumulation of ashes which blocks the duct and forces the fire to again draw draft air from the adjoining room.

In an effort to avoid the problem of ashes falling into the duct, the duct is frequently located in a position other than below the fire itself such as at the side of the fireplace. However, if the duct is moved from a location below the fire, one loses an important benefit of direct application of draft air. Specifically, air applied from below generally enhances the fire because the oxygen in the air has the opportunity to intimately mix with the burning material without disturbing the flames. On the other hand, air applied from above or a side tends to extinguish the fire, just as when one blows on a candle flame.

Another deficiency of a duct placed at a location remote from the fire itself is that costs are increased. For example, a remotely located duct such as at the front of the fireplace, as shown in Ashman, Jr. U.S. Pat. No. 3,976,048, requires additional conduits which add to material and labor costs.

A frequently encountered inadequacy of a duct which vents directly into the fireplace is that the draft air is applied to the burning material in a concentrated form over an area which is essentially the same as the cross-sectional area of the duct. Frequently, however, the combustible material is spread over an area significantly greater than that of the duct. Thus, one portion of the fire receives a greater supply of oxygen and burns more intensely than the rest. Thus, the combustible material is consumed unevenly because oxygen is supplied in an uneven manner.

Figure 2:
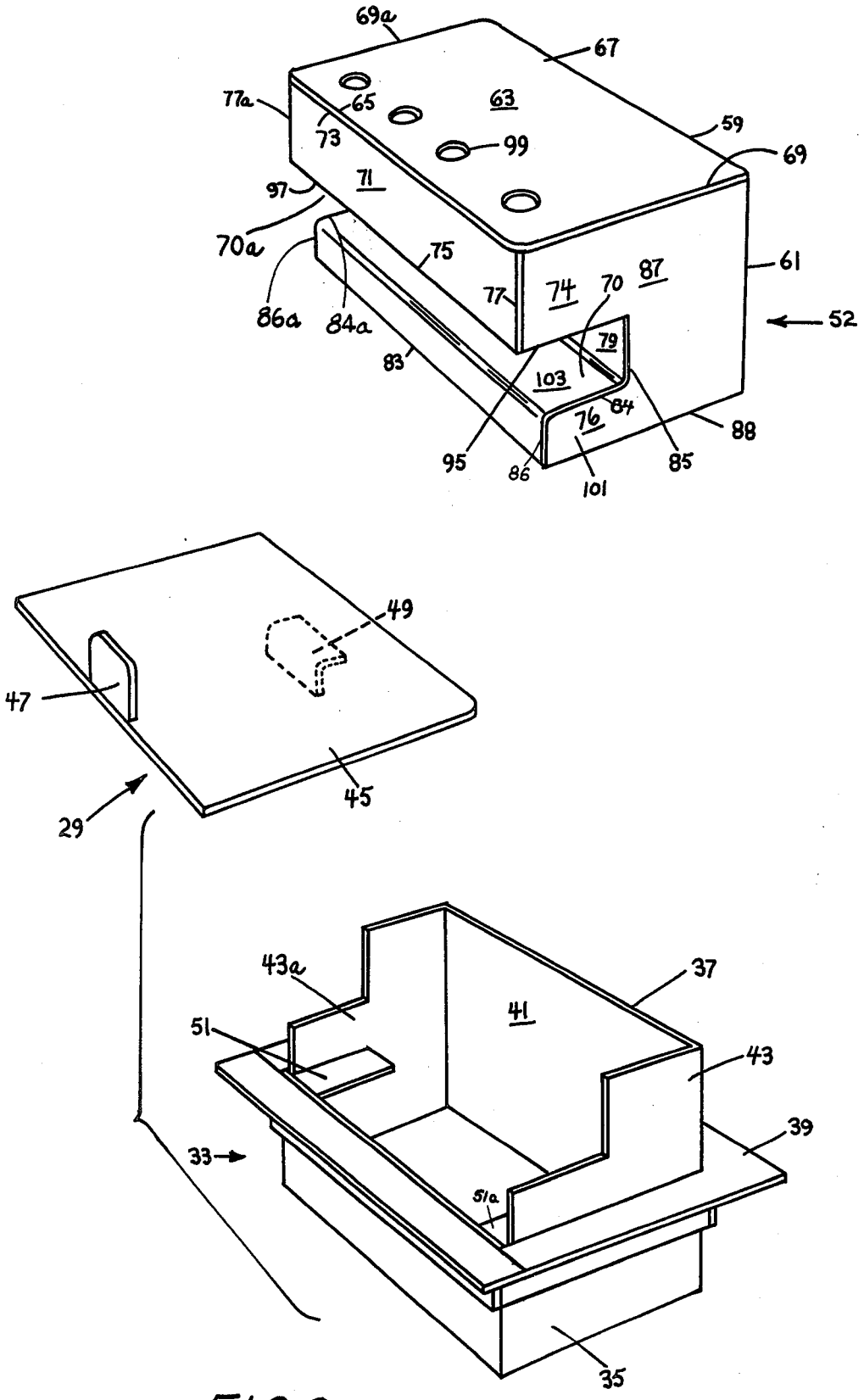

It is therefore an object of the present invention to provide an improved system for conducting outside air into a fireplace. It is another object to provide such an improved system that is self-cleaning of ashes. It is also an object of the present invention to provide air directing means which are easily and inexpensively incorporated into a fireplace structure. It is a further object to provide air directing means for distributing draft air over an area of the lower surface of combustible material which is singnificantly greater than the cross-sectional area of the duct. Further objects and advantages will become apparent through reference to the description and accompanying drawings. In the drawings:

FIG. 1 is a representation, partly in section of a fireplace embodying various features of the present system; and FIG. 2 is an exploded perspective view of a hood embodying various of the features of the invention.

The disclosed system includes in combination with a fireplace and grate means including a bottom side disposed above the floor, a duct having an outside end in fluid communication with a source of outside air and terminating at its inside end at a location below the grate means, damper means adjustably controlling the cross-sectional area of the duct, hood means covering the inside terminal end of the duct, the hood means including a throat section defining a first passageway in fluid communication with the inside terminal end of the duct, a lateral section defining a cover for the throat section and further defining a second passageway in fluid communication with the first passageway and directing the flow of fluid from the first passageway to a substantially non-vertical flow direction, thereby permitting essentially unrestricted air flow from the duct into the fireplace and essentially preventing passage of particulate matter into the duct while simultaneously distributing the outside air laterally beneath said grate.

Referring to the drawings, there is depicted fireplace 11 comprising a front wall 13, including door means 15, closing the front opening 14, a rear wall 17, a floor 19, a pair of oppositely disposed side walls 21 and 21*a* (not shown), and a chimney 23. A duct 25 is included in the floor 19 to provide flow communication between the fireplace 11 and the atmosphere outside of the building 27 which contains the fireplace. Resting upon the fireplace floor 19, above the duct 25, is an andiron or a grate 31 upon which combustible materials, such as logs 30, are held while burning so that combustion air may circulate to the materials from below.

As shown in FIGS. 1 and 2, the inside end 26 of the duct 25 is provided with an adapter 33, including a depending peripheral skirt 35 having a cross section adapted to be matingly received in the end 26 of the duct 25. The skirt 35 extends into the duct a distance adapted to prevent tipping motion by the adaptor 33. The adaptor 33 further includes a hood bushing 37 and an outwardly extending peripheral support flange 39. When skirt 35 is inserted into the duct 25, the support flange 39 engages the fireplace floor 19 around the entire periphery of the duct 25. The peripheral engagement ensures that air flowing through the duct 25 passes through the adapter 33. The hood bushing 37 of the adaptor 33 comprises a rear wall 41 and generally parallel side walls 43 and 43*a*, each of which projects perpendicularly upwardly from the plane defined by the support flange 39.

Slidably mounted upon the support flange 39, between the side walls 43 and 43*a* is a damper 29, comprising a plate 45, an adjusting lug 47 and a check lug 49. The damper 29 is adjustable from a closed position in which it occludes the adaptor 33, to an open position in which substantially free air flow is allowed through the adaptor. Brackets 51 and 51*a* are provided on the interior surface of the duct bushing 37, in the same plane as the support flange 39, to provide additional support for the damper 29. Non-linear sliding motion by the damper 29 is prohibited by the hood bushing side walls 43 and 43*a* . Linear sliding motion is limited to the space between the hood bushing rear wall 41 and the support flange portion opposed thereto by the check lug 49.

A hood 52 is fitted over the hood bushing 37 with its peripheral bottom edges 57, 83 and 88 for example, resting on the flange 39, and defines a passageway for directing the flow of air from the conduit 25 and the adaptor 33 to the fireplace at a location below the logs 30. The bushing 37 extends into the hood 52 a distance adapted to prevent tipping of the hood.

The hood 52 includes an upright rear wall 55, side panels 87 and 87*a* joined at their respective edges 61 and 61*a* (not shown) to the rear wall 55. A cover panel 63 is joined at its side and rear edges 69, 69*a* and 67, respectively, to the upper edges of the rear wall and side panels. A forward wall 71 of a vertical dimension about one-half the corresponding vertical dimension of the rear wall is joined to and depends from the forward edge 65 of the cover panel 63.

Each of the side panels 87 and 87*a* are formed with a recess 70 and 70*a* , respectively, extending from the forward edge of each side panel rearwardly by about one-half the depth dimension (front to rear) of the side panel. By reason of this recess, each side panel defines upper and lower panel sections 74 and 76 that are spaced apart vertically from one another. The upper panel section 74, for example, of each panel is joined at its forward edge to the side edges 77 and 77*a* , respectively, of the forward wall 71. The area bounded by the bottom edge 75 of the front wall and the bottom edges 95 and 95*a* of the horizontal sections 74 and 74*a* defines an outlet opening 78 for the flow of air outwardly from the interior of the hood 52. At the same time, air can flow outwardly from the hood through a plurality of openings 99 provided in the cover panel 63 at locations adjacent the forward edge 65 of the cover panel and above the opening 78.

The rear edges 85 and 85*a* of the recesses 70 and 70*a* are connected by a wall panel 79 that extends downwardly to also connect the upper edges 84 and 84*a* and the forward edges 86 and 86*a* of the second sections 76 and 76*a* of the side panels 87 and 87*a* . The upper edge of the wall panel 79, in one embodiment, extends upwardly and rearwardly into the interior of the hood 52 in a position partly across the path of air flowing through the hood in the form of a baffle 81. As will appear more fully hereinafter, this baffle aids in directing the distribution of air exiting the hood 52.

It will be recognized from the foregoing description that the hood 52 comprises a throat section 89 that is in fluid communication with the duct 25, and a lateral section 92 that defines a cover for the throat section to redirect the upwardly flow of air through the throat section to a horizontal flow direction. The distance between wall panel 79 and the rear wall 55 of the hood is approximately equal to the distance between the wall panel 79 and the forward wall 71, so that the cross-sectional area of the throat section 89 is approximately equal to that of the outlet opening 78.

Notably, the openings 99 defined in the cover panel 63 are located proximate to the forward edge 65, forwardly of the throat section 89, and above the horizontal portion 103 of the wall panel 79. Such a location prevents ashes which fall through the openings 99 from entering the throat section 89, but rather the ashes land on the panel portion 103 where they do not impede the flow of air to the fire.

As seen in FIG. 1, the lower edge 83 of the panel 79 is preferably spaced upwardly from the support flange 39 by a distance sufficient to allow sliding motion of the damper plate 45 therebetween. Thus, ashes are prevented from being carried into the duct 25 by passing between the damper plate 45 and the baffle wall 79.

As depicted, the duct 25, includes an inlet 105 through which air from the outside atmosphere enters the duct 25. A louvered cover 109 is preferably attached over the duct inlet 105 to protect against entrance by leaves, animals, etc. As noted, the duct 25 terminates at its inside end at a location below the grate 31 and receives the skirt 35 of the adapter 33 and is peripherally sealed by the support flange 39. The damper 29 is horizontally slidably mounted within and across the air flow path through the throat section of the hood, to regulate the flow of air from the duct 25 to the hood.

In a preferred situation, after a fire is started in the fireplace, the front opening 14 thereof is closed, as by the door 15, to restrict the flow of inside air from the room into the fireplace. It is not required to close the fireplace opening but an open front reduces the advantages to be realized from the present system. As the combustion material burns, oxygen is removed from the air surrounding the material. The oxygen-depleted air is heated and travels upwardly through the chimney 23, creating a relatively low pressure within the fireplace 11. Replacement air is available essentially only through the duct 25 because the door 15 prohibits passage of air from the dwelling into the fireplace 11 and the fireplace walls and floor are generally impermeable masonry.

Outside air drawn through the duct 25, passes through the adapter and into the throat section 89 of the hood which directs the air upwardly until it strikes the upper wall 63. The air is then directed laterally by the lateral section 92 until it strikes the forward wall 71, after which a portion of the air passes upwardly through the openings 99 for direct application (through the grate) to the fire substantially directly over the hood 52. The rest of the air passes outwardly and upwardly from the hood in a generally semi-circular or fan pattern for application to the fire at positions remote from the area of the fire which is directly over the hood 52, i.e. the side and forward areas of the fire.

As the combustible material burns, ashes remain, which then fall through the grate 31 to the fireplace floor 19. Ashes directed toward the duct 25 instead strike the walls of the hood, particularly the upper wall 63, which bars the ashes from entering the duct 25. Ashes that pass through the openings 99 fall to the wall panel 103 and are prevented by the wall 79 from laterally entering the duct 25.

As ashes accumulate upon the upper wall 63 and the baffle ledge 103 they fall therefrom and onto the fireplace floor. The requirement for ash removal is minimized in the present system by reason of the air flowing through the openings 99 and outlet 78 continuously sweeping ashes from the upper wall 63 and wall section 103.

Adjustment of the damper 29 between open and closed positions effectively controls the amount of air which is applied to a fire, which in turn controls the rate of combustion. Thus, through sliding adjustment of the damper 29, an operator can control the rate of combustion. In addition, at times it has been found desirable to supply the fire with a combination of inside air and outside air. To this end, the damper 29 is placed in a position between the open and closed positions to constrict air flow from the duct 25. At the same time, the door 15 is at least partially open to allow air flow from the dwelling.

When combustion has been completed, the damper 29 is returned to the closed position, by sliding between the baffle wall lower edge and the support flange, to prevent further introduction of outside air to the fireplace 11.

Over extended periods of use and exposure to intense heat, the hood 52 can become warped or even burn out, i.e. develop holes through its walls or cover, or minimal amounts of ashes can eventually accumulate in the duct 25. In accordance with the present system the hood 52 is removable by lifting the hood 52 from the adapter 33 and can be readily and inexpensively replaced. Further, the damper 29 is readily removed from the adapter 33 to provide access to the duct 25 for cleaning purposes.

While a preferred embodiment has been shown and described, it will be understood that there is no intent to limit the invention by such disclosure, but rather, it is intended to cover all modifications and alternate constructions falling within the spirit and scope fo the invention as defined in the appended claims.

What is claimed is:

1. In a fireplace comprising a floor, a rear wall, a pair of oppositely disposed side walls, and grate means including a bottom side disposed above said floor, the combination of a duct having an outside end in fluid communication with a source of outside air and terminating at its inside end at a location below said grate means, damper means adjustably controlling the cross-sectional area of said duct, hood means covering said inside terminal end of said duct, said hood means including a throat section defining a first passageway in fluid communication with said inside terminal end of said duct, a lateral section defining a cover for said throat section and further defining a second passageway in fluid communication with said first passageway and directing the flow of fluid from said first passageway to a substantially non-vertical flow direction, said lateral section further defining a downwardly opening outlet thereby permitting essentially unrestricted air flow from said duct into said fireplace and essentially preventing passage of particulate matter into said duct while simultaneously distributing said outside air laterally beneath said grate.

2. An apparatus as described in claim 1 including adaptor means removably received between said inside end of said duct and said hood means.

3. An apparatus as described in claim 2 wherein said cover defined by said lateral section defines a plurality of openings disposed beneath said grate and said downwardly opening outlet directs air therefrom in a fan pattern over a substantial area of the bottom side of said grate.

4. An apparatus as described in claim 1, wherein said hood is removably mounted relative to said duct to selectively provide direct access to said duct.

5. An apparatus as described in claim 1 wherein said damper comprises a plate, including a stop and a lug, adapted to slide over said fireplace bottom wall and below said hood means between open and closed positions.

* * * * *